US006862822B1

(12) United States Patent
Masse

(10) Patent No.: US 6,862,822 B1
(45) Date of Patent: Mar. 8, 2005

(54) MOBILE RAILWAY TRACK REPAIR APPARATUS

(76) Inventor: Ken Masse, R.R. #6 Box 227A, Edmonton, Alberta (CA), T5B 4K3

( * ) Notice: Subject to any disclaimer, the term of this patent is extended or adjusted under 35 U.S.C. 154(b) by 46 days.

(21) Appl. No.: 10/414,798

(22) Filed: Apr. 16, 2003

(51) Int. Cl.[7] ..... E02F 5/22
(52) U.S. Cl. ..... 37/104
(58) Field of Search ..... 37/104; 104/9; 171/16

(56) References Cited

U.S. PATENT DOCUMENTS

| | | | | |
|---|---|---|---|---|
| 3,096,829 A | | 7/1963 | Plasser et al. | 171/16 |
| 3,457,660 A | | 7/1969 | Speno | 37/105 |
| 3,612,184 A | | 10/1971 | Plasser et al. | 171/16 |
| 3,967,395 A | | 7/1976 | Stewart | 37/104 |
| 4,042,035 A | | 8/1977 | Boyer | 171/16 |
| 4,102,066 A | | 7/1978 | Christoff | 37/104 |
| 4,108,076 A | | 8/1978 | Knape | 104/2 |
| 4,152,991 A | | 5/1979 | Stedman et al. | 104/7 R |
| 4,240,354 A | * | 12/1980 | Newman | 105/72.2 |
| 4,245,703 A | | 1/1981 | Theuere et al. | 171/16 |
| 4,478,289 A | | 10/1984 | Enix | 172/136 |
| 4,705,115 A | | 11/1987 | Whitaker, Jr. | 171/16 |
| 4,850,123 A | | 7/1989 | Whitaker, Jr. | 37/104 |
| 4,858,344 A | | 8/1989 | Cotsford | 37/104 |
| 5,109,775 A | | 5/1992 | Kershaw et al. | 104/2 |
| 5,596,822 A | | 1/1997 | Desmarais et al. | 37/104 |

* cited by examiner

*Primary Examiner*—Christopher J. Novosad
(74) *Attorney, Agent, or Firm*—Sturm & Fix LLP

(57) ABSTRACT

A mobile railway track repair apparatus (10) that includes a mobile unit (11) having a cab (22) rotatably supported on a dual mode undercarriage (21) wherein, a boom unit (12) is pivotally supported by the cab (22) and includes a boom support column (31) pivotally attached to a boom arm (32) having a universal connector unit (13) provided on its lower end (34).

In addition, the universal connector unit (13) is operatively connected to an undercutter assembly (50) wherein, a plurality of hydraulic piston elements (35) (35') and (35") are employed to manipulate the boom support column (31), the boom arm (32), and the universal connector unit (13) to position the undercutter assembly in a generally transverse relationship to the rail bed (101) to extract weakened ballast (104) from beneath the railroad track (100).

13 Claims, 2 Drawing Sheets

MOBILE RAILWAY TRACK REPAIR APPARATUS

BACKGROUND OF THE INVENTION

CROSS REFERENCE TO RELATED APPLICATIONS

Not applicable.

1. Field of the Invention

The present invention relates to the field of railway track maintenance and repair machines in general and in particular to a multi-task repair apparatus that is particularly well suited to track undercutting.

2. Description of Related Art

As can be seen by reference to the following U.S. Pat. Nos. 4,854,344; 5,596,822; 4,478,289; 4,152,991; 4,042,035, and 3967,395, the prior art is replete with myriad and diverse railway track repair and maintenance machines each devoted to a single specialized task.

While all of the aforementioned prior art constructions are more than adequate for the basic purpose and function for which they have been specifically designed, they are uniformly deficient with respect to their failure to provide a simple, efficient, and practical multi-task track repair apparatus that is capable of not only trenching, tamping/compacting, and excavating, but undercutting, as well.

As mentioned above, the current state of railway track repair machines is directed toward a single focused task approach with one machine performing a single function. In addition, the current approach to repairing soft spots beneath a section of track involves threading a continuous running chain under the tracks from one side to the other of the undercutting machine, which is a time consuming laborious task.

As a consequence of the foregoing situation, there has existed a longstanding need for a new and improved multi-task track repair apparatus that cannot only perform all of the tasks required to repair soft spots beneath the track, but which also can undercut the soft spot from either side of the track rather than both sides simultaneously, and the provision of such an apparatus is the stated objective of the present invention.

BRIEF SUMMARY OF THE INVENTION

Briefly stated, the mobile multi-task track repair apparatus that forms the basis of the present invention comprises in general a mobile unit, a boom unit, a universal connector unit and a plurality of specialized tool assemblies adapted to be installed on the universal connector unit and manipulated by the boom unit to effect the necessary repairs to the track bed.

As will be explained in greater detail further on in the specification, in the preferred embodiment of the invention, an undercutter assembly is employed on the end of the boom unit via the universal connector unit wherein the mobile unit and the boom unit are adapted to cooperate with one another to position the undercutter assembly beneath the level of the railroad ties and in a generally transverse direction to the rails of the railroad track to excavate spoiled ballast from the railroad bed.

The undercutter assembly comprises a generally elongated undercutter member having an elongated track that rotatably supports a closed loop chain drive provided with a plurality of digging cups that are adapted to remove the ballast beneath the railroad tracks form either side of the railroad tracks without the need for any type of other equipment passing entirely beneath the tracks and projecting out both sides of the tracks.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
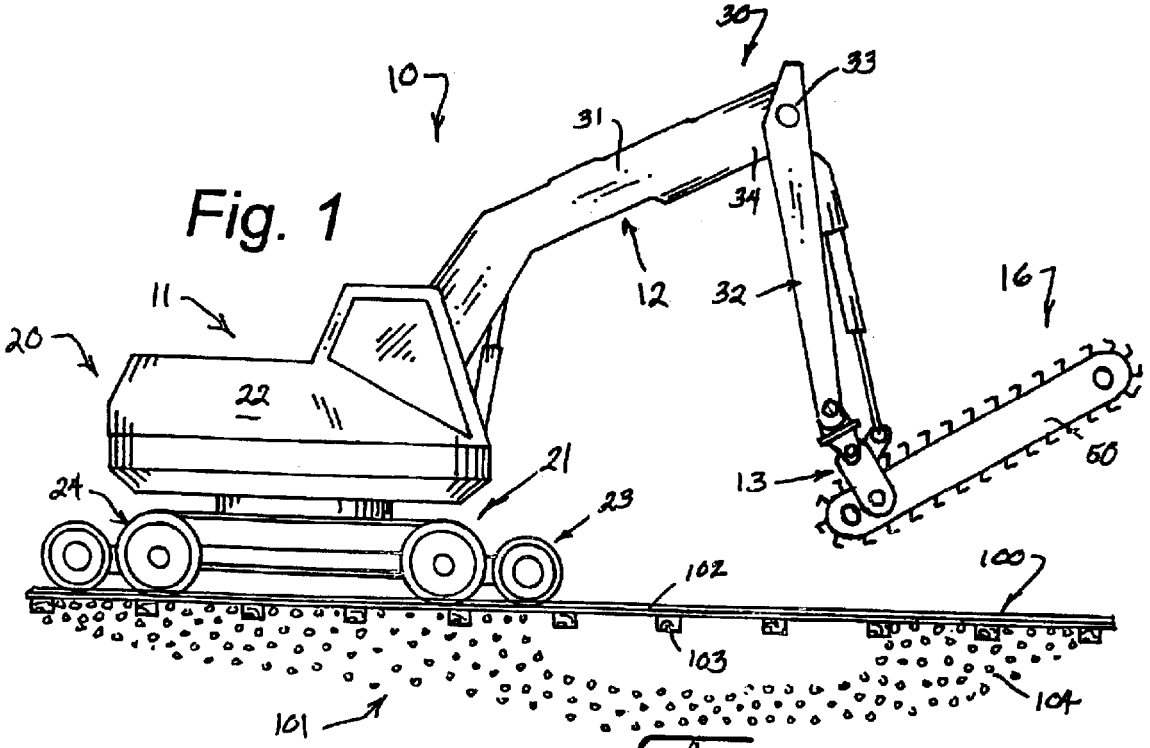
FIG. 1 is a side elevation view of the track repair apparatus with an undercutter assembly.
Figure 3:
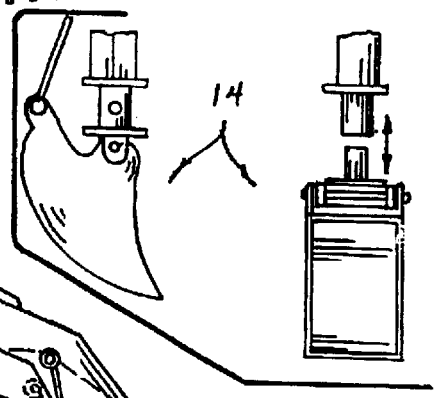
FIG. 3 is a combined front and side view of the excavating bucket.
Figure 2:
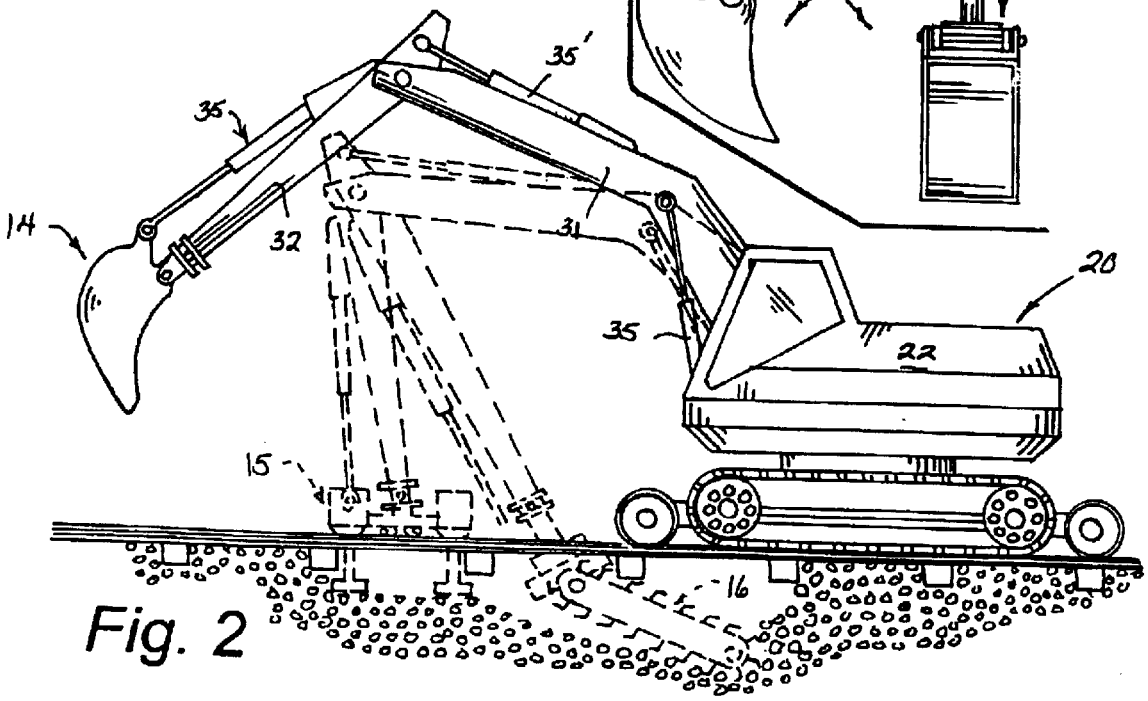
FIG. 2 is a side elevation view off the track repair apparatus and the various accessories that can be employed therewith.

As can be seen by reference to the drawings, and in particular to FIGS. 1 and 2, the multi-task track repair apparatus that forms the basis of the present invention is designated generally by the reference number 10. The repair apparatus 10 comprises in general a mobile unit 11, a boom unit 12, a universal connector unit 13, an excavator assembly 14, a tamping/compacting assembly 15, and an undercutter assembly 16. These units will now be described in seriatim fashion.

As shown in FIGS. 1 and 2, the mobile unit 11 comprises a motorized track traversing member 20 having a dual mode undercarriage 21 that supports a rotating turret style cab 22 wherein, the undercarriage 21 employs both a rail engaging flanged wheel assembly 23 and a crawler track assembly 24 wherein the flanged wheel assembly 23 may be raised relative to the crawler track assembly 24 in a well recognized fashion to allow the repair apparatus 10 to gain access and egress from the railway tracks 100 without requiring the presence of a siding to do so, as well as, ditching/excavating, etc.

As can be seen by reference to FIGS. 1, 2, 5, and 6, the cab 22 is rotatably supported on the undercarriage 21 to support and position the boom unit 12 and the associated tool assemblies 14 15 and 16 at numerous angular inclinations relative to both the railroad track 100 and track bed 101 wherein, the railroad track 100 includes parallel rails 102 connected by a plurality of cross-ties 103 which rest on the track bed ballast 104.

As can best be appreciated by reference to FIGS. 1 and 2, the boom unit 12 comprises an articulated boom member 30 including a boom support column 31 and a boom arm 32 pivotally secured on its upper end 33 to the upper end 34 of the boom support column 31 in a well recognized fashion.

In addition, the articulated boom member 30 further includes a pair of first and second hydraulic piston members 35 35' operatively associated with the boom support column 31 wherein, the first hydraulic piston member 35 controls the pivotal movement of the boom support column 31 relative to the cab 22 and the second hydraulic piston member 35' controls the pivotal movement of the upper end 33 of the boom arm 32 relative to the upper end 34 of the boom support column 31 in a well recognized fashion.

Still referring to FIGS. 1 and 2, it can be seen that the boom member 30 further includes a third hydraulic piston member 35" operatively connected on its upper end proximate the upper end of the boom arm 32 wherein, the lower ends of both the boom arm 32 and the third hydraulic piston member 35" are adapted to be operatively connected to the universal connector unit 13 as will be explained presently.

Figure 4:
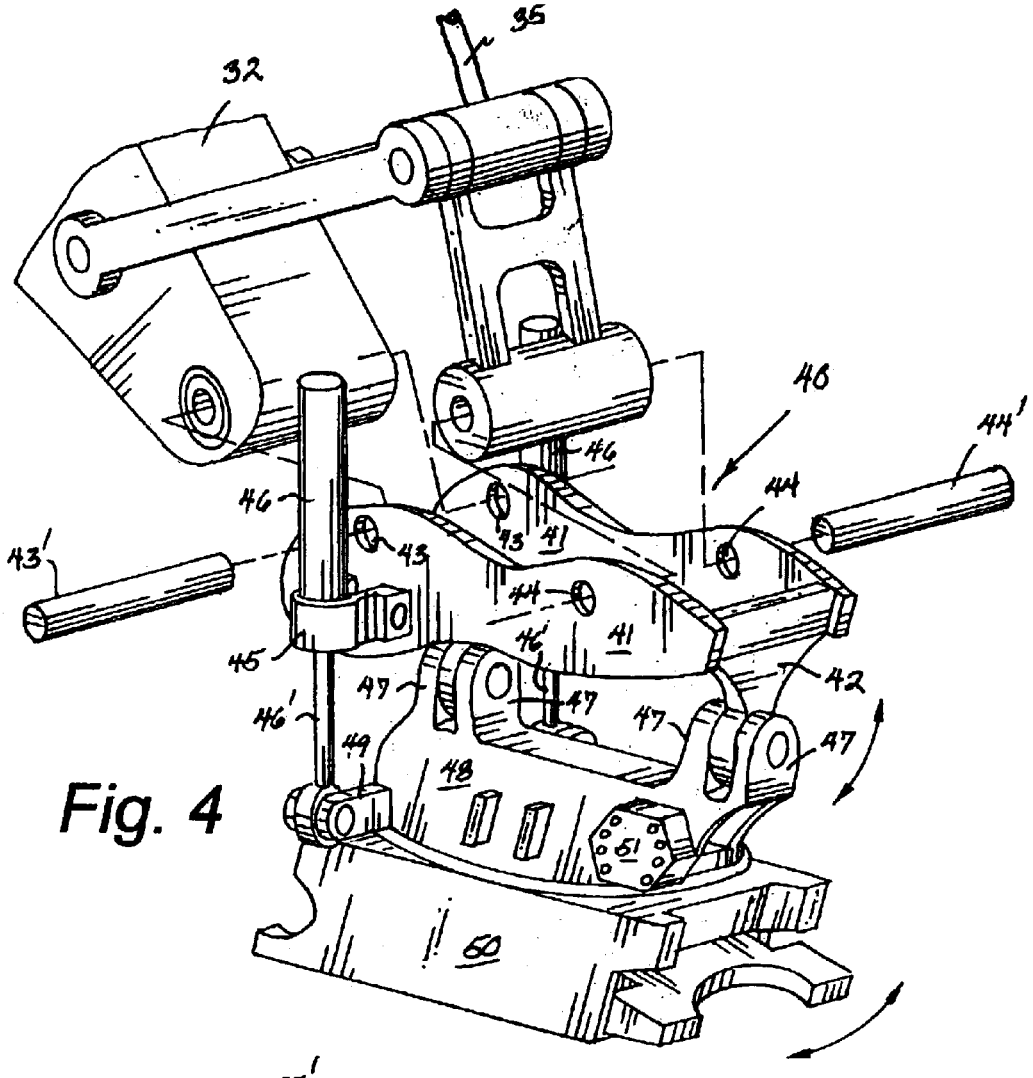
FIG. 4 is an isolated detail view of the universal connector unit.

Turning now to FIG. 4, it can be seen that the universal connector unit 13 comprises a universal connector member 40 including a pair of pivot hinge plates 41 operatively connected together on their opposite ends by a pair of downwardly depending rocker arms 42 wherein, the pivot hinge plates 41 are provided with a pair of opposed rear apertures 43 and a pair of front apertures 44 dimensioned to receive a pair of pivot rods 43' and 44' for operatively connecting the universal connector member 40 to the lower end of the boom arm 32 and the operative end of the third hydraulic piston element 35" such that the pivot hinge plates 41 will pivot in a controlled manner about the axis of pivot rod 43'.

In addition, the outer rear portion of the pivot hinge plates 41 is further provided with brackets 45 that are operatively engaged with hydraulic piston cylinders 46 the purpose and function of which will be explained presently.

As can also be seen by reference to FIG. 4, the pair of downwardly depending rocker arms 42 of the hinge plates 41 are pivotally connected to complementary pair of rocker arms 47 that project upwardly from a rocker panel 48 having a rear portion provided with a pair of outwardly projecting arm elements 49 that are operatively and pivotally connected to the piston rods 46' that are reciprocable within the hydraulic piston elements 46 in a well recognized manner.

Furthermore, the lower end of the rocker panel 48 is operatively connected to a rotatable turntable 50 the rotational disposition of which is relative to the rocker panel 48 governed by a gearbox 51 that likewise operates in a well recognized manner.

Figure 5:
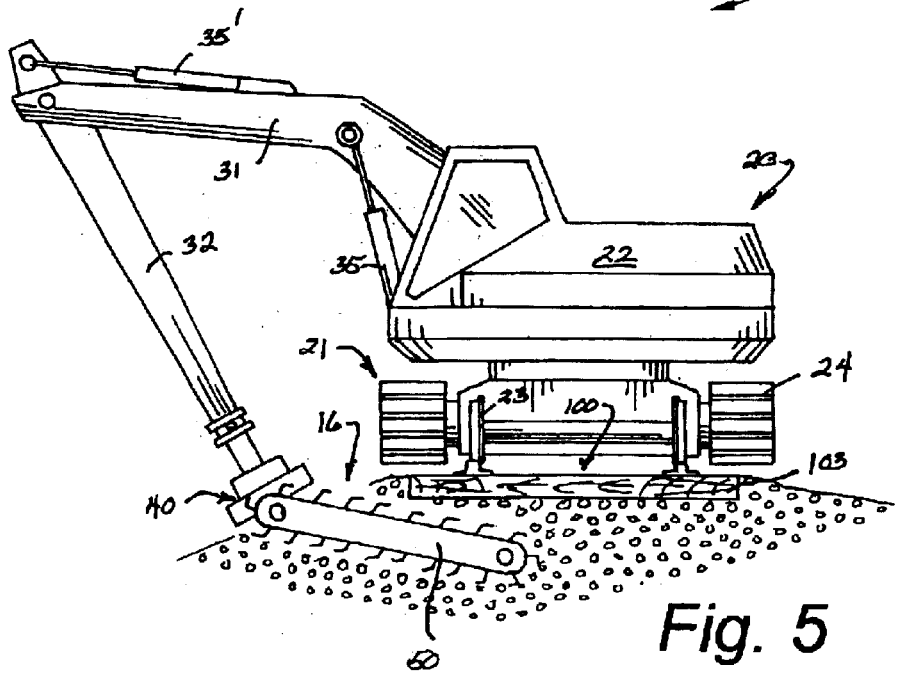
FIG. 5 is a front plan view showing the backcutter assembly penetrating the track bed beneath the track repair apparatus.

By now it should be appreciated that the universal connector member 40 allows either an excavator assembly 14, a tamping/compacting assembly 15, or an undercutter assembly to be tilted up or down via the rocker panel 48 and piston cylinders 46 and piston rods 46' wherein, the rotary turntable 50 and the hydraulic piston members 35 35' and 35" manipulate the articulated boom member 30 and the attached repair assembly 14 15 or 16 in a desired orientation relative to a railroad track 100 including directly beneath and parallel with the cross ties 103 to remove weakened track bed ballast 104 as depicted in FIG. 5.

As can be seen by reference to FIGS. 1 and 5, the undercutter assembly 16 comprises an undercutter member 50 having an elongated track arm 61, the proximal end of which is pivotally connected to the universal connector member 40 wherein, the track arm 51 rotatably supports a looped chain drive 52 carrying a plurality of digging cups 53 for excavating weak ballast 104 from the rail bed 101.

Furthermore, as can best be appreciated by reference to FIGS. 1, 2, and 5, the track repair apparatus 10 can be moved along the railroad tracks 100 to a location where weak ballast 104 must be removed from beneath the tracks. Once the apparatus 10 straddles the desired location, the cab 22 is rotated relative to the undercarriage 21 to position the longitudinal axis of the boom member 30 perpendicular to the rails 102. The first and second hydraulic piston element 35 35' can position the undercutter member 50 against that portion of ballast 104 that has to be removed.

It should also be appreciated that should the undercutter member 50 lack sufficient length to extract all of the necessary ballast 104 beneath the apparatus 10 from one side of the railroad tracks 100, the cab 22 can be rotated 180° to attack the weakened portion of the rail bed 101 from the other side of the railroad tracks.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A mobile railway track repair apparatus for undercutting and removing ballast from a rail bed which supports rail ties that in turn support parallel rails wherein, the repair apparatus comprisesU;

a mobile unit including a motorized track traversing member that includes an undercarriage that supports a rotating cab;

a boom unit including an articulated boom member operatively associated with the rotating cab of the track traversing member wherein, the boom member includes a boom support column and a boom arm having an upper end pivotally connected to said boom column and having a lower end;

a universal connector unit including a universal connector member having one portion pivotally associated with the lower end of the boom arm and a track repair assembly selected from among an excavator assembly, an undercutter assembly and a tamping/compacting assembly wherein, the track repair assembly being operatively associated with the universal connector member; and, first means for moving the boom column relative to the track traversing member, second means for moving the boom arm relative to the boom column, and third means for moving the undercutter assembly relative to the universal connector member and the boom arm for positioning the selected track repair assembly parallel to at a selected variable angle and beneath the rail ties from a selected side of a railroad track.

2. The repair apparatus as in claim 1; wherein, said undercarriage is provided with flanged wheels adapted to ride on the parallel rails of the railroad track.

3. The repair apparatus as in claim 1; wherein, said undercarriage is provided with a crawler track assembly adapted to ride on that portion of the rail ties that lies between the parallel rails.

4. The repair apparatus as in claim 1; wherein, said undercarriage is provided with both flanged wheels adapted to ride on the parallel rails of the railroad track and a crawler track assembly adapted to ride on that portion of the rail ties that lies between the parallel rails.

5. The repair apparatus as in claim 4; wherein, the boom column has a lower end pivotally connected to the cab of the motorized track traversing member.

6. The apparatus as in claim 5; wherein, said first, second and third means each comprises hydraulic piston members.

7. The apparatus as in claim 6; wherein, the selected track repair assembly comprises the undercutter assembly which includes an undercutter member having an elongated track that rotatably supports a looped chain drive that is provided with a plurality of digging cups; and, the universal connector member includes a pair of pivot hinge plates movably suspended between the lower end of the boom arm and a portion of the elongated track of the undercutter member.

8. The apparatus as in claim 7; wherein, the universal connector member further includes a rocker panel pivotally associated with said pair of pivot hinge plates.

9. The repair apparatus as in claim 1; wherein, the boom column has a lower end pivotally connected to the cab of the motorized track traversing member.

10. The repair apparatus as in claim 9; wherein, said first, second and third means each comprise hydraulic piston members.

11. The repair apparatus as in claim 10; wherein, the selected track repair assembly comprises the undercutter assembly which includes an undercutter member having an elongated track that rotatably supports a looped chain drive that is provided with a plurality of digging cups; and, the universal connector member includes a pair of pivot hinge plates movably suspended between the lower end of the boom arm and a portion of the elongated track of the undercutter member.

12. The repair apparatus as in claim 11; wherein, the universal connector member further includes a rocker panel pivotally associated with said pair of pivot hinge plates.

13. The apparatus as in claim 12; wherein, the universal connector member also includes a rotatable turntable suspended beneath the rocker panel.

* * * * *